United States Patent [19]

Biermann et al.

[11] Patent Number: 4,925,559

[45] Date of Patent: May 15, 1990

[54] USE OF DERIVATIVES OF TRICYCLO-(5.2.1.02,6)-DEC-3-ENE AS FROTHERS IN THE FLOTATION OF COAL AND ORES

[75] Inventors: Manfred Biermann, Muelheim/Ruhr; Rita Koester, Neuss; Horst Eierdanz, Hilden, all of Fed. Rep. of Germany

[73] Assignee: Henkel Kommandtgesellschaft auf Aktien, Duesseldorf, Fed. Rep. of Germany

[21] Appl. No.: 164,166

[22] Filed: Mar. 4, 1988

[30] Foreign Application Priority Data

Mar. 5, 1987 [DE] Fed. Rep. of Germany ..... 3707034

[51] Int. Cl.[5] ..... B03D 1/02

[52] U.S. Cl. ..... 209/166; 252/61

[58] Field of Search ..... 209/162, 163, 164, 165, 209/167, 166; 44/51; 252/61; 75/2

[56] References Cited

U.S. PATENT DOCUMENTS

| | | | |
|---|---|---|---|
| 2,395,452 | 2/1946 | Bruson | 260/497 |
| 3,118,938 | 1/1964 | Stuart et al. | 75/2 |
| 3,332,978 | 7/1967 | Caldwell | 75/2 |
| 4,412,843 | 11/1983 | Burgess et al. | 44/62 |
| 4,564,369 | 1/1986 | Burgess et al. | 44/51 |

FOREIGN PATENT DOCUMENTS

| | | |
|---|---|---|
| 0113310 | 7/1984 | European Pat. Off. . |
| 1930671 | 6/1969 | Fed. Rep. of Germany . |
| 1930864 | 6/1969 | Fed. Rep. of Germany . |

OTHER PUBLICATIONS

*Hackh's Chemical Dictionary*, ed. by J. Grant, 4th Ed., (1969), pp. XI, 272, 723.

J. Am. Chem. vol. 67, 1945, pp. 1178–1180.

*Primary Examiner*—Robert L. Stoll

*Attorney, Agent, or Firm*—Ernest G. Szoke; Wayne C. Jaeschke; Henry E. Millson, Jr.

[57] ABSTRACT

Derivatives of tricyclo-[5.2.1.0$^{2,6}$]-dec-3-ene corresponding to the following general formula (I)

in which $R^1$ is hydrogen; a linear or branched $C_1$–$C_8$ alkyl radical; an acyl radical $R^2$-CO, where $R^2$ is hydrogen or a linear or branched $C_1$–$C_{18}$ alkyl or alkenyl radical; or a hydroxyalkyl radical in which $R^3$ and $R^4$ independently of one another may be hydrogen or a hydroxy group and m and n are integers of 0 to 5 and the sum (m+n) is an integer of 1 to 5, with the proviso that at least one of the radicals $R^3$ and $R^4$ is a hydroxy group; are used as frothers in the flotation of coal and ores.

11 Claims, 3 Drawing Sheets

USE OF DERIVATIVES OF TRICYCLO-(5.2.1.02,6)-DEC-3-ENE AS FROTHERS IN THE FLOTATION OF COAL AND ORES

BACKGROUND OF THE INVENTION

1. Field of the Invention

This invention relates to the use of derivatives of tricylco-[5.2.1.$0^{2,6}$]-dec-3-ene as frothers in the flotation of coal and ores.

2. Statement of Related Art

Run-of-the mine coal or rough coal from coal mining is widely worked up mechanically utilizing the differences in density. In the process of working up, the rough coal is mechanically separated into a coal fraction and a so-called "dirt fraction".

Flotation is preferred as a separation process, particularly for fine coal (particle size below 0.5 mm), the fine coal being separated from the ash on the basis of different surface properties of coal particles and dirt particles. To this end, use is made of the natural, water repellent character of the surface of coal particles which is enhanced by adsorption of hydrophobic reagents. In suitable media, fine coal and ash can be separated by a flotation process which is now being successfully used on an industrial scale. In the flotation process, the fine coal particles are attached to froth bubbles of a sufficiently stable froth produced by addition of a frother and discharged in this way from the flotation cell.

In principle, the criteria set forth above with respect to the flotation of coal apply equally to the flotation of ores. In this field, the valuable mineral in the ores is intended to be separated from the gang by the flotation process and the minerals enriched in the valuable mineral fraction by successive application of individual flotation steps. To this end, the ore is size-reduced and preferably wet-ground and subjected to the flotation process after addition of a frother and a collector and other chemicals necessary for or useful in the flotation process. Appropriate formulation of the pulp with respect to pH, type and concentration of the collectors and type and concentration of the frothers enables the valuable mineral to be selectively separated from the gangue in high yields. In this connection, it should be noted that an increase in the yield or selectivity by only a few percentage points through reagent combinations of different composition or improved flotation cells may be regarded as a successful improvement of considerable economic significance, because the daily throughputs in the industrial processing of coal and ores are often of the order of several tens of thousands of tons of ore. An increase of several tons in the yield of valuable mineral in an industrial flotation process is regarded as highly advantageous.

The effect of a frother, which generally consists of molecules having a polar part and an apolar part, is not confined solely to the generation of the froth. Characteristics of the froth of importance to the process, such as bubble size, bubble strength and bubble cohesion, can be controlled through the type and quantity of the frothers. Also, the frother generally influences the other constituents of the flotation pulp. The influence of the frother is undesirable when it acts non-selectively on the collectors which are intended to modify the hydrophilicity of the particle surface and to provide for better adhesion of the particles to the froth bubbles. Accordingly, it has hitherto been desirable to use only those frothers of which the properties only affect the stability and strength of the froth and, in addition, provide for minimal consumption, but do not affect other parameters of the process (cf. Ullmanns Enzyklopädie der technischen Chemie, 4th Edition, Verlag Chemie, Weinheim (1972), Vol. 2, page 110 et seq.).

According to "Ullmann" loc. cit., frothers for flotation processes are not intended to possess any structures which lead to parallel orientation of the individual molecules. Accordingly, it is preferred to use hydrocarbons having branched chains and a symmetrically arranged hydrocarbon group. The frothers described include terpenes of various structures, pine oil which consists predominantly of terpene alcohols, for example terpinol, and also cresol and a number of synthetic frothers, such as for example methylisobutylcarbinol (MIBC) and triethoxybutane (TEB).

The optimal use of the frothers set forth above is determined not only by the separation problem to be solved, but also, as stated above, by the other components present in the pulp, such as collectors, regulators, etc.

Published German Application No. 19 30 671 describes a flotation based process for the separation of minerals from ore in an aqueous pulp in which air is introduced into the pulp containing a frother and separation of the valuable minerals is facilitated by means of the air bubbles formed. The frother used is a reaction product of ethylene oxide or propylene oxide with alcohols or glycols or lower alkyl monoethers thereof.

Published German Application No. 19 30 864 describes a process analogous to the process described in DE-OS No. 19 30 671, in which the frother used is the reaction product of ethylene oxide, propylene oxide or mixtures thereof with a monohydric alcohol containing at least three hydroxy groups in the molecule. The frothers disclosed in the two above-cited publications may be used both for the flotation of coal and for the flotation of a large number of ores and lead to a satisfactory discharge of the fractions which it is desired to enrich by the flotation process. Where conventional collectors are used, the frother was not observed to have any unfavorable effect on the properties of the collector in the flotation pulp. However, the selectivity of many separation processes was not entirely satisfactory, so that there is still a need for highly selective collectors which, in addition, lead to a high yield of the desired fraction.

In addition, EP-A No. 0 113 310 describes flotation processes for coal using frothers. The frothers used are reaction products of a monobasic or dibasic $C_1$–$C_{10}$ carboxylic acid and a polyhydroxy compound, the resulting ester alcohols containing at least one free hydroxy group. Products containing branched alkyl groups which contain a total of 6 to 19 carbon atoms are disclosed as preferred in EP-A-0 113 310.

DESCRIPTION OF THE INVENTION

Figure 1:
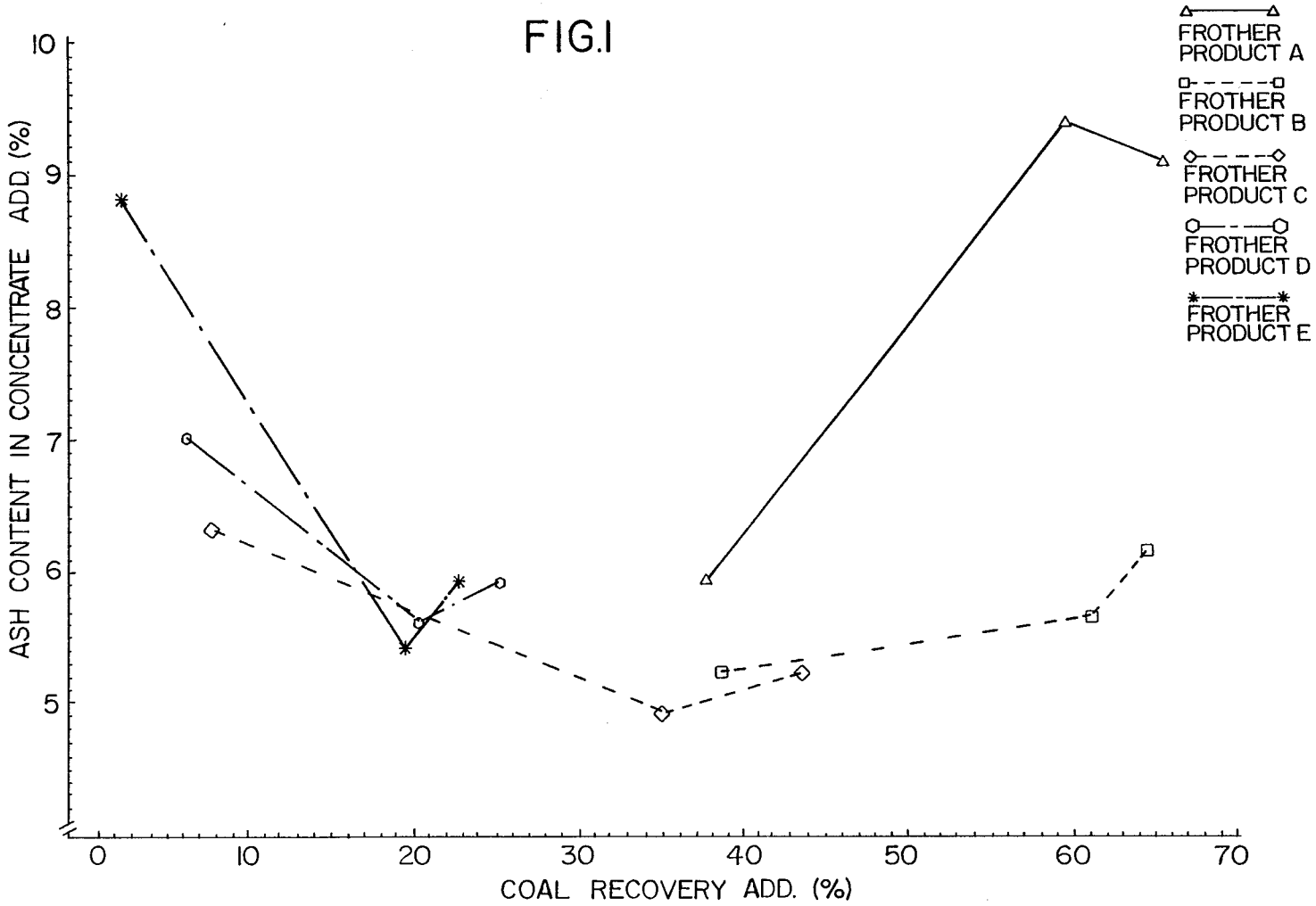
FIG. 1 shows the effectiveness of dicyclopentadiene plus monocarboxylic acids in the flotation of coal.

Other than in the operating examples, or where otherwise indicated, all numbers expressing quantities of ingredients or reaction conditions used herein are to be understood as modified in all instances by the term "about".

It has now surprisingly been found that derivatives of tricylco-[5.2.1.0$^{2,6}$]-dec-3-ene have excellent properties as flotation frothers which make them at least equivalent and even superior to hitherto known flotation frothers. In addition, it has been found that not only are these derivatives compatible with the other constituents of the flotation pulps, a requirement which conventional frothers have to satisfy, they also have a positive effect on the influence of the collector in the flotation pulp, i.e. they enhance or boost the collector effect, and are thus able to contribute toward reducing the quantity in which the compounds added as collectors are used.

The present invention relates to the use of derivatives of tricylco-[5.2.1.0$^{2,6}$]-dec-3-ene corresponding to the following general formula

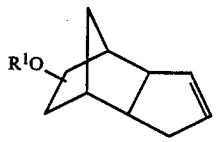

(I)

in which $R^1$ is hydrogen; a linear or branched $C_1$–$C_8$ alkyl radical; an acyl radical of the formula $R^2$—CO— where $R^2$ is hydrogen or a linear or branched $C_1$–$C_{18}$ alkyl or alkenyl radical; or a hydroxyalkyl radical of the formula

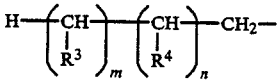

in which $R^3$ and $R^4$ independently of one another are hydrogen or a hydroxy group, and m and n are integers of 0 to 5 and the sum (m+n) is an integer of 1 to 5, with the proviso that at least one of the substituents $R^3$ and $R^4$ is a hydroxy group, and/or of mixtures of several isomeric derivatives (I) as frothers in the flotation of coal and ores.

The derivatives corresponding to general formula (I)

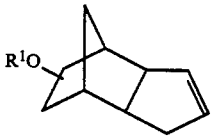

(I)

suitable for use in accordance with the invention can be compounds in which the substituent $R^1O$ is attached to the carbon atom in the 8 or 9 position of the tricyclic ring system. In addition to hydrogen, the substituent $R^1$ may be a linear or branched $C_1$–$C_8$ alkyl radical, such as methyl, ethyl, n-propyl, i-propyl, n-butyl, sec.-butyl, tert.-butyl, n-pentyl, n-hexyl, n-heptyl, or n-octyl, and isomers thereof. Particularly preferred alkyl radicals are $C_1$–$C_4$ alkyl radicals. Particularly good frother results are obtained where $R^1$ is an ethyl radical.

In addition, the substituent $R^1$ is general formula (I) above may also be an acyl radical $R^2$—CO, where $R^2$ is hydrogen or a linear or branched $C_1$–$C_{18}$ alkyl or alkenyl radical. Such acyl radicals include radicals of the formula $R^2$—CO in which $R^2$ is ethyl, propyl, butyl, pentyl, hexyl, heptyl, octyl, nonyl, decyl, undecyl, dodecyl, tridecyl, tetradecyl, pentadecyl, hexadecyl, heptadecyl, or octadecyl. The particular alkyl radicals may be linear or branched. In addition, they may contain one or more double bonds at any position in the molecule. In general formula (I), RI preferably represents acyl radicals emanating from lower $C_2$–$C_6$ carboxylic acids or from fatty acids obtainable from native sources, such as for example coconut oil or palm oil. $R^1$ preferably represents acetyl, propionyl, caproyl, lauryl, or oleyl.

In general formula (I) above for the tricylco-[5.2 1.0$^{2,6}$]-dec-3-ene derivatives suitable for use in accordance with the invention, the substituent $R^1$ may also be a hydroxyalkyl radical corresponding to the following formula

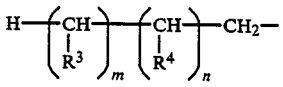

The radicals represented by this formula independently of one another contain hydrogen or hydroxy groups as substituents $R^3$ and $R^4$ In addition, m and n are integers of 0 to 5, preferably 1 to 3, and the sum (m+n) is an integer of 1 to 5. It is essential that at least one, and preferably at least two, of the substituents $R^3$ and $R^4$ is a hydroxy group. Hence, $R^1$ emanates from dihydric or polyhydric alcohols containing 2 to 6 carbon atoms in the alkyl chain; the particular hydroxy groups may be positioned not only at the carbon atoms in the 1 position, but also at one or more following carbon atoms in the chain. The compounds of general formula (I) comprising such a radical $R^1$ are thus ethers of 8(9)-hydroxytricyclo-[5.2.1.0$^{2,6}$]-dec-3-ene with ethanediol, propane-1,2-diol, propane-1,3-diol, propanetriol, the various isomeric butanediols, triols or tetraols and the corresponding difunctional or polyfunctional pentaols and hexaols. The ethers of ethanediol and of glycerol are preferred.

The processes by which the tricylco-[5.2.1.0$^{2,6}$]-dec-3-ene derivatives suitable for use in accordance with the invention are prepared are known from the prior art. In J. Am Chem. Soc. 67, 1178 (1945), H. A. Bruson and Th. W. Riener describe the synthesis of esters of 8(9)-hydroxytricyclo-[5.2.1.0$^{2,6}$]-dec-3-ene. A comparable process is also described in U.S. Pat. No. 2,395,452. Esters of general formula (I), in which $R^1$ has the meaning $R^2$-C=0, are analogously prepared in known manner by reaction of tricylco-5.2.1.0$^{2,6}$]-dec-3,8-diene corresponding to the following formula

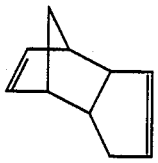

(II)

(dicylcopentadiene) with carboxylic acids corresponding to the general formula $R^2$COOH, in which $R^2$ is as defined above, in the presence of catalytic quantities of mineral acids. Reactants for the dicyclopentadiene (II) are preferably $C_1$–$C_6$ carboxylic acids, such as for example acetic acid, propionic acid or caproic acid, or fatty acids obtainable from natural fats and oils by ester cleavage, preferably lauric acid or oleic acid.

Ethers corresponding to general formula (I) are synthesized by reaction of dicyclopentadiene (II) with monohydric or polyhydric alcohols corresponding to the formulae $R^1OH$ or

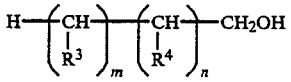

in which $R^1$, $R^3$, $R^4$, m and n are as defined above. The monohydric alcohols preferably used contain a $C_1$–$C_4$ alkyl radical as the radical $R^1$. Although it is of particular advantage to use ethanol, polyhydric alcohols may also be used for the reaction with dicyclopentadiene (II). Ethanediol and glycerol are representatives of the polyhydric alcohols particularly suitable for this purpose.

The reaction of (II) with mineral acids alone, for example with $H_2SO_4$, gives 8(9)-hydroxytricylco-[5.2.1.$0^{2,6}$]-dec-3-ene, i.e. the compound of general formula (I) in which RI is hydrogen.

The above reactions are normally carried out at temperatures in the range of from 20° to 150° C. and preferably at temperatures in the range of from 40° to 60° C., optionally in an organic solvent. Suitable organic solvents are, in particular, aliphatic or aromatic hydrocarbons, more especially toluene or xylene, or mixtures thereof. Catalysts in reactions for the preparation of derivatives (I) of tricylco-[5.2.1.$0^{2,6}$]-dec-3-ene may be any of the compounds known from the prior art for alkylation or acylation reactions of the above type, for example, mineral acids, such as HCl or $H_2SO_4$, and Lewis acids. Among the Lewis acids, boron trifluoride etherate or antimony fluoride can be used with advantage.

On completion of the reaction, which gives high yields of the derivatives of general formula (I) or mixtures thereof in a reaction time of, in most cases, 1 to 10 hours, the solvent is optionally removed, preferably by distillation. The residue remaining then consists—apart from small quantities of starting materials—of derivatives corresponding to general formula (I) or, optionally, mixtures of the isomeric compounds (I) which bear the substituent $R^1O$— in the 8 position or 9 position of the tricyclic ring system. The educt/product mixtures are then purified by methods known per se. This may be done, for example, by distillation or by chromatographic methods.

The compounds of general formula (I) suitable for use in accordance with the invention or isomer mixtures thereof are eminently suitable for use as frothers in the flotation of coal and ores. Experimentally, it was found that the esters, i.e. compounds in which $R^1=R^2C=O$, show slightly better frother properties than the corresponding ethers, i.e. compounds in which $R^1$ is alkyl or hydroxyalkyl.

Compared with standard flotation frothers, for example 2-ethyl hexanol, a much higher recovery of coal or ores was achieved. In the flotation of coal, there was considerably less residual ash in the concentrate. Accordingly, the selectivity of the compounds of the invention used as frothers was very good.

In addition, it is clear in practical application that the derivatives (I) have a boosting effect on a number of collectors of the type normally used in flotation processes. The result of this booster effect is that the quantities in which the compounds added as collectors are used may be distinctly reduced.

The compounds of formula I are employed as frothers in the flotation of coal and ores in a quantity of from 10 to 250 g/ton, preferably from 20 to 150 g/ton.

The invention is illustrated by not limited by the following Examples.

(A) Preparation of the compounds to be used in accordance with the invention (1) Preparation of esters corresponding to general formula (I) of dicyclopentadiene (II) and carboxylic acids.

10 g boron trifluoride etherate were added dropwise to 66 g dicyclopentadiene and 141 g oleic acid in a flask. The dark solution formed was slowly heated to 55° C. and then kept at that temperature for 6 hours which required occasional cooling.

1 l toluene was added to the reaction mixture, followed by washing with water. The organic phase separated off was washed with 1% by weight sodium carbonate solution and then with water until it showed a neutral reaction, and then dried with calcium chloride. The residue remaining after evaporation of the toluene in a water jet vacuum was distilled in a high vacuum. 90 g of the oleic acid ester of 8(9)-hydroxytricyclo-[5.2.1.$0^{2,6}$]-dec-3-ene (product E) distilled over at 218°–230° C./0.1 mbar.

Products A to D were similarly obtained from dicyclopentadiene and acetic acid, propionic acid, caproic acid and lauric acid. The physical properties of these products are shown in Table 1 below.

TABLE 1

Esters corresponding to general formula (I) of dicyclopentadiene (II) and carboxylic acids $R^2COOH$.

| Product | $R^2$ | Bp. (mbar) |
|---|---|---|
| A | $CH_3$ | 95–110/1 |
| B | $C_2H_5$ | 85–90/0.1 |
| C | $C_5H_{11}$ | 117–120/0.1 |
| D | $C_{11}H_{23}$ | 170–210/0.1 |
| E | $C_{17}H_{31}$ | 218–230/0.1 |

Products A to E were light yellow, clear, thinly liquid substances.

(2) Preparation of ethers corresponding to general formula (I) of dicyclopentadiene (II) and monohydric alcohols $R^1OH$.

1450 g dicyclopentadiene were quickly added dropwise with stirring to 1300 g 2-ethyl hexanol and 80 ml boron trifluoride diethyl etherate in a flask. The mixture was heated to 100° C. and kept at that temperature for 4 hours. The cooled reaction mixture was dissolved in ether. The ethereal solution was washed first with dilute sodium hydroxide and then with water until it showed a neutral reaction. After drying with calcium chloride, the ether was distilled off. The residue was distilled in a high vacuum. 2148 g of the 2-ethylhexylether of 8(9)-hydroxytricyclo [5.2 1.$0^{2,6}$]-dec-3-ene (product K) distilled over at 115°–120° C./0.1 mbar.

Products F to J were similarly prepared from dicyclopentadiene and methanol, ethanol, n-propanol and sec.-butanol. The physical properties of products F to K are shown in Table 2 below.

TABLE 2

Ethers corresponding to general formula (I) of dicyclopentadiene (II) and monohydric alcohols $R^1OH$.

| Product | $R^1$ | Appearance, consistency | Bp. (°C./mbar) |
|---|---|---|---|
| F | $CH_3$ | Light yellow, thinly liquid | 93–95/18 |
| G | $C_2H_5$ | yellow, thinly liquid | 109/18 |
| H | n-$C_3H_7$ | light yellow, thinly liquid | 120–124/16 |
| I | i-$C_3H_7$ | brown, thinly liquid | 109/16 |
| J | sec-$C_4H_9$ | colorless, thinly liquid | 84/1 |
| K | $C_4H_9CH(C_2H_5)CH_2$ | colorless, liquid | 115–120/1 |

(3) Preparation of ethers corresponding to general formula (I) of dicyclopentadiene (II) and monohydric alcohols.

268 g dicyclopentadiene were added dropwise with stirring over a period of 3 hours at 100° C. to a mixture of 161 g ethylene glycol and 15.6 g acidic ion exchanger (Amberlyst 15) in a flask. The ion exchanger was then separated off by filtration. The filtrate was washed with water, dried with calcium chloride and distilled in a high vacuum. 268 g of the ethylene glycol ether of 8(9)-hydroxytricyclo-[5.2.1.$0^{2,6}$]-dec-3-ene (product L) distilled over at 108°–120° C./0.1 mbar.

Product M was similarly obtained from dicyclopentadiene and glycerol. The physical properties of products L and M are shown in Table 3 below.

TABLE 3

Ethers corresponding to general formula (I) of dicyclopentadiene (II) and polyhydric alcohols.

| Product | m | n | $R^3$ | $R^4$ | Appearance, consistency | Bp. (°C./mbar) |
|---|---|---|---|---|---|---|
| L | 0 | 1 | — | OH | colorless, liquid | 108–120/1 |
| M | 1 | 1 | OH | OH | colorless, thinly liquid | 134–137/1 |

(4) Preparation of 8(9)-hydroxytricyclo-[5.2.1.$0^{2,6}$]-dec-3-ene from dicyclopentadiene (II).

264 g dicyclopentadiene and 800 g 25% by weight sulfuric acid were heated with stirring for 5 hours to the reflux temperature in a flask. The organic phase was then separated off, washed with water, dilute sodium hydroxide and then again with water, and dried with calcium chloride. 243 g 8(9)-hydroxytricyclo-[5.2.1.$0^{2,6}$]-dec-3-ene (product N) distilled over at 105°–115° C. during distillation in vacuo.

(B) Flotation of coal

The flotation of coal was carried out in accordance with DIN 22017. Three of the six flotation stages prescribed in the DIN specification were carried out in stages because the first flotation stages in particular provide information as to the effectiveness of the frother to be investigated in the flotation of coal. The compounds of formula (I) were added to the flotation pulp in undiluted form.

Fine-particle coal having the following feed content was used for the flotation tests:

32.3% ash approx. 1.50% total sulfur

Particle size distribution:

<25μm: 21.9%;

25 to 80 μm: 9.1%;

80 to 160 μm: 12.0%;

160 to 315 μm: 16.0%;

>315 μm: 41.0%.

Flotation was carried out in a KHD MN 935/04 laboratory flotation cell (volume 2:1) with a solids concentration of 150 g/l tapwater (approx. 16° Gh). Flotation was carried out in accordance with the above-cited DIN specification 22017 "Rohstoffuntersuchungen im Steinkohlebergbau, Flotationsanalyse (Raw Material Test in Coal Mining, Flotation Analysis)". The flotation conditions were as follows:

First flotation concentrate:

150 g frother/t;

1 min. preconditioning at 3000 r.p.m. and 1 min. flotation at 2000 r.p.m.

Second floation concentrate:

100 g frother/t;

without preconditioning;

1 min. flotation at 2000 r.p.m.

Third flotation concentrate:

15 g frother/t;

without preconditioning;

1 min. flotation at 2000 r.p.m.

Two criteria were used for evaluating flotation:

(a) coal recovery (in %) and (b) selectivity or ash content of concentrate (in %).

COMPARISON EXAMPLE

The frothers tested were evaluated by comparison with standard frothers known from the prior art. Methyl isobutyl carbinol (MIBC), pine oil and 2-ethylhexanol were used as standard frothers in a comparison tests. The results are shown in Table 4.

TABLE 4

Effectiveness and selectivity of known frothers in the flotation of coal.

| Frother | g/t | Flot. stage | Coal recovery V(%) | Ash content in concentrate a(%) | Add. values V(%) | Add. values a(%) |
|---|---|---|---|---|---|---|
| MIBC | 150 | C1 | 10.27 | 10.9 | 10.27 | 10.9 |
| | 100 | C2 | 14.46 | 6.9 | 24.73 | 8.6 |
| | 15 | C3 | 14.10 | 7.0 | 38.83 | 8.0 |
| | | Σ | 38.83 | | | |
| Pine oil | 150 | C1 | 31.98 | 6.6 | 31.98 | 6.6 |
| | 10 | C2 | 22.43 | 7.6 | 54.41 | 7.0 |
| | 15 | C3 | 7.16 | 15.9 | 61.57 | 8.0 |
| | | Σ | 61.57 | | | |
| 2-ethyl hexanol | 150 | C1 | 37.08 | 5.5 | 37.08 | 5.5 |
| | 100 | C2 | 16.08 | 6.9 | 53.16 | 5.9 |
| | 13 | C3 | 3.76 | 10.3 | 56.92 | 6.2 |
| | | Σ | 56.92 | | | |

C1 = concentrate 1, C2 = concentrate 2, C3 = concentrate 3

Result

In the flotation of coal, 2-ethyl hexanol shows the best results of the known frothers on the basis of the fine coal floated: the ash content in the concentrate is comparatively low for a high coal recovery.

EXAMPLE 1

Flotation of coal using the frothers of Preparation Example 1.

Under the flotation conditions described in Comparison Example 1, products A to E from Preparation Example 1 (esters of 8(9)-hydroxytricyclo-[5.2.1.$0^{2,6}$]-dec-3-ene with carboxylic acids) showed the results with respect to effectiveness (coal recovery) and selectivity (ash content in the concentrate) set out in the form of a graph in FIG. 1. Result:

The frothing effect is most favorable in the case of the reaction products of dicyclopentadiene (II) with acetic acid and propionic acid, depending on the length of the alkyl chain of the monocarboxylic acid. The propionic acid ester matches the standard frother 2-ethyl hexanol in selectivity and effectiveness.

EXAMPLE 2

Flotation using the ethers of preparation Example 2.

Figure 2:
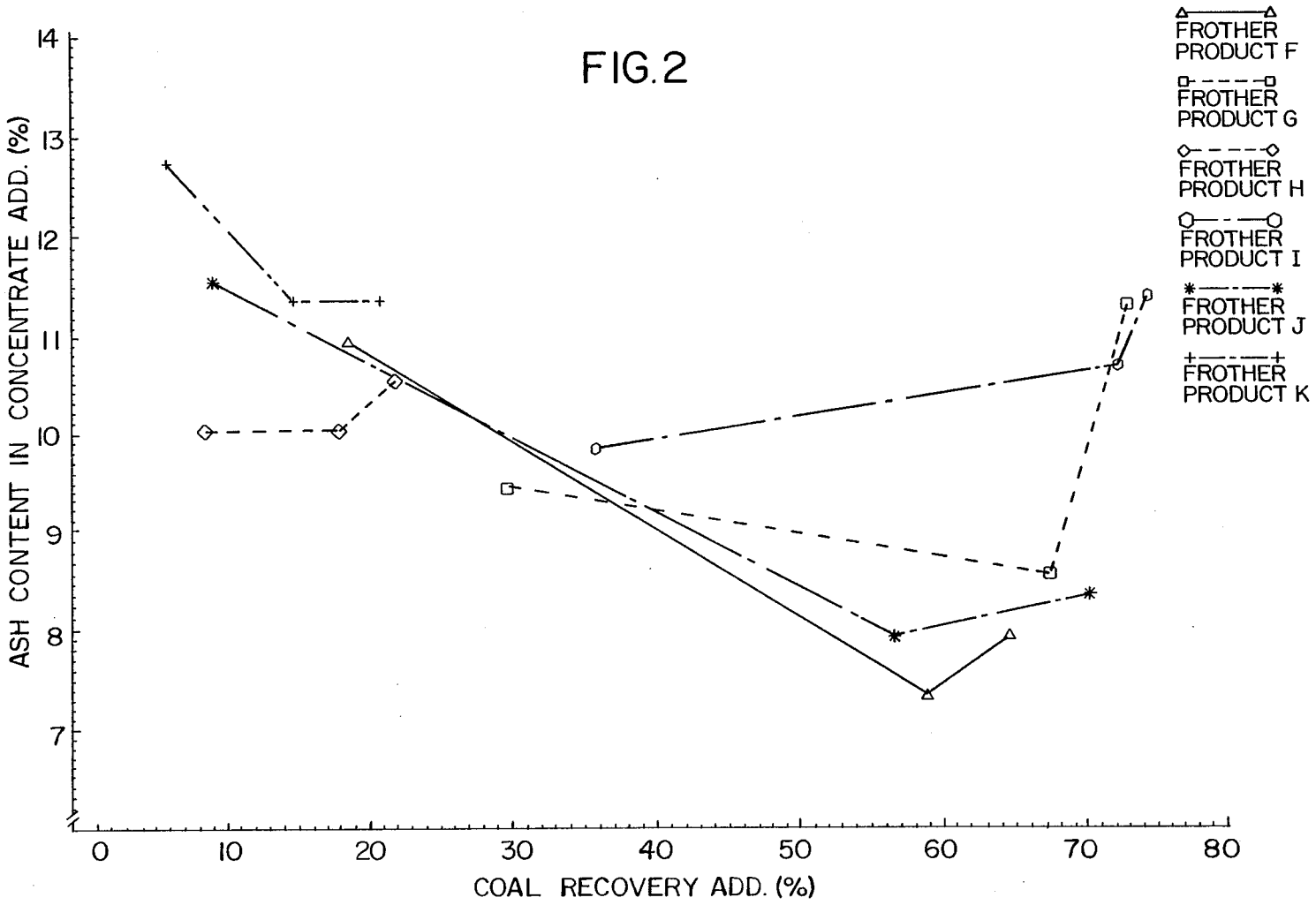
FIG. 2 shows the effectiveness of dicyclopentadiene plus monohydric alcohols in the flotation of coal.

Flotation tests were carried out as described above using products F to K of Preparation Example 2 (reaction products of dicyclopentadiene (II) and monohydric alcohols). The results are shown in the form of a graph in FIG. 2. Result:

The frothers according to the invention of general formula (I), in which $R^1$ is a $C_1$–$C_4$ alkyl radical, more especially methyl, ethyl, isopropyl or isobutyl, show distinctly better frothing properties than the standard frother 2-ethyl hexanol.

EXAMPLE 3

Flotation using the ethers of Preparation Example 3.

Figure 3:
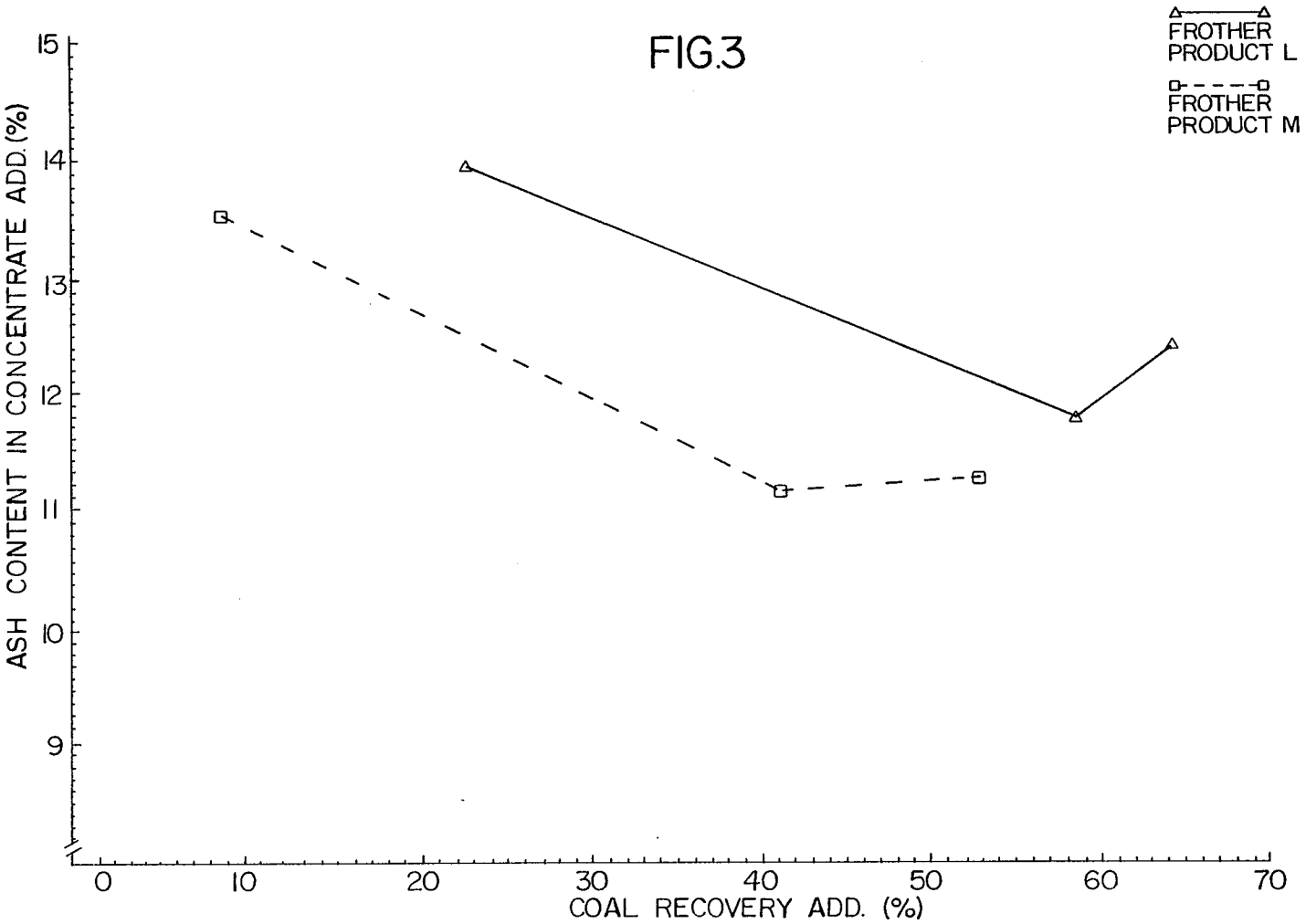
FIG. 3 shows the effectiveness of dicyclopentadiene plus polyhydric alcohols in the flotation of coal.

Flotation tests were carried out as in Example 1 using products L and M of Preparation Example 3 (ethers corresponding to general formula (I) of dicyclopentadiene (II) and polyhydric alcohols). The results are shown in the form of a graph in FIG. 3.

(C) Flotation of ores

EXAMPLE 4

Flotation of cassiterite

The material to be floated was a South African cassiterite containing approx. 1% $SnO_2$, 59% silicates and 7% magnetite and hematite. The flotation batch had the following particle size distribution:

| | |
|---|---|
| −25 μm | 49.5% |
| 25–62 μm | 43.8% |
| 63–80 μm | 4.9% |
| +80 μm | 0.9% |

The flotation tests were carried out in a Denver type D1 1-liter laboratory flotation cell with pulp densities of approx. 500 g/l tapwater (16° Gh). Waterglass was added at 2200 g/t at a pH value of 7–8, followed by conditioning. The pH value was then adjusted to 5 with sulfuric acid before the collector was added. A preconcentrate was floated in 2 stages without subsequent purification steps.

Styrene phosphonic acid (techn. quality) was used as collector in all the tests.

Frothers B and N were directly added to the flotation pulp in undiluted form using a microliter pipette.

The results are shown in Table 5 below.

TABLE 5

| Flotation of cassiterite | | | | |
|---|---|---|---|---|
| Collector Styrene phosphonic acid (g/t) | Flotation stage | Frother (g/t) | $SnO_2$ recovery (%) | $SnO_2$ content (%) |
| 450 | rc | — | 86 | 5.7 |
| | waste | | 14 | 0.1 |
| | feed | | 100 | 1.3 |
| 225 | rc | Prod. B 100 | 85 | 5.8 |
| | waste | | 15 | 0.1 |
| | feed | | 100 | 1.2 |
| 150 | rc | Prod. N 50 | 70 | 10.3 |
| | waste | | 30 | 0.3 |

TABLE 5-continued

| Flotation of cassiterite | | | | |
|---|---|---|---|---|
| Collector Styrene phosphonic acid (g/t) | Flotation stage | Frother (g/t) | $SnO_2$ recovery (%) | $SnO_2$ content (%) |
| | feed | | 100 | 1.3 |

The foregoing results show that products B and N considerably reduce the consumption of collector (styrene phosphonic acid) but nevertheless provide for very high yields of cassiterite. Product N in particular has a booster effect on the collector.

EXAMPLE 5

Flotation of sulfidic ores

The ore to be floated was a disseminated ore from the Harz which, for the laboratory flotation, was only ground to such an extent that the more coarsely intergrown minerals were sufficiently digested. To obtain satisfactory separation by flotation and to obtain marketable concentrates, the ore is normally reground and refloated in the dressing plant. The rougher flotations in the laboratory tests are sufficiently conclusive for the frother tests by comparison with the standard frother methyl isobutyl carbinol (MIBC).

| | | |
|---|---|---|
| Mean analysis: | approx. | 8.5% PbO |
| | | 11.6% $Fe_2O_3$ |
| | | 21.0% ZnO |
| | | 2.7% CuO |
| Particle size of the flotation batch: | | |
| | −25 μm | 35.1% |
| | 25–63 μm | 13.9% |
| | 63–100 μm | 11.5% |
| | 100–200 μm | 29.5% |
| | +200 μm | 10.0% |

The flotation tests were carried out in a type of D1 1-liter Denver laboratory flotation cell with a pulp density of approx. 500 g/ tapwater (16° Gh). In the first stage, lead and copper were collectively floated at a natural pH of 7.5 using the standard collector potassium amyl xanthate (140 g/t) and sodium cyanide (150 g/t) and zinc sulfate (400 g/t) as regulators. In the 2nd flotation stage, zinc was floated at pH 10 using sodium isopropyl xanthate (120 g/t) as collector, copper sulfate (600 g/t) as regulator and products B and N as frothers. The results of the flotation tests are shown in the following Table.

TABLE 6

| Flotation of sulfidic ores | | | | | | |
|---|---|---|---|---|---|---|
| Frother (g/t) | Flotation stage | Metal recovery (%) | Content PbO | CuO | ZnO | $Fe_2O_3$ |
| MIBC 40 | Pb/Cu | 78/79 | 13.1 | 2.5 | 26.7 | 12.2 |
| 40 | Zn | 30 | 4.9 | 0.9 | 24.3 | 11.2 |
| | Feed | 100 | 8.3 | 1.6 | 20.7 | 11.6 |
| Product B 20 | Pb/Cu | 77/62 | 13.3 | 2.6 | 25.5 | 13.4 |
| 40 | Zn | 45 | 5.6 | 1.1 | 28.4 | 12.4 |
| | Feed | 100 | 8.5 | 1.5 | 21.4 | 12.0 |
| Product N 40 | Pb/Cu | 80/74 | 12.3 | 1.8 | 23.8 | 10.8 |
| 20 | Zn | 35 | 3.9 | 0.8 | 25.1 | 14.0 |
| | Feed | 100 | 7.6 | 1.2 | 20.1 | 11.5 |

The frothers B and N according to the invention achieved the same metal recovery in this rougher flotation for a reduced dosage compared with the standard frother MIBC.

We claim:

1. In a process for the flotation of coal and ores, the improvement comprising the use therein of a frother effective quantity of at least one derivative of tricyclo-[5.2.1.0$^{2,6}$]-dec -3-ene corresponding to the following formula:

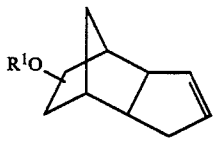

in which $R^1$ is selected from the group consisting of hydrogen, a linear or branched C1–C8 alkyl radical, an acyl radical, $R^2$—CO where $R^2$ selected from the group consisting of is hydrogen, or a linear $C_1$–$C_{18}$ alkyl radical, a linear $C_1$–$C_{18}$ alkenyl radical, a branched $C_1$–$C_{18}$ alkyl radical, a branched $C_1$–$C_{18}$ alkenyl radical, and a hydroxyalkyl radical

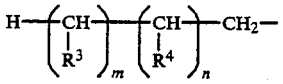

in which $R^3$ $R^4$ independently of one another are hydrogen or a hydroxy group, m and n are integers of 0 to 5 and the sum (M+n) is an integer of 1 to 5, with the proviso that at least one of the substituents $R^3$ and $R^4$ is a hydroxy group.

2. The process of claim 1 wherein the frother effective quantity is from about 10 to about 250 g/ton of coal or ore.

3. The process of claim 2 wherein the frother effective quantity is from about 20 to about 150 g/ton.

4. The process of claim 1 wherein $R^1$ is a linear or branched $C_1$–$C_4$ alkyl radical.

5. The process of claim 1 wherein $R^1$ is ethyl.

6. The process of claim 1 wherein $R^1$ is a $C_2$–$C_6$ acyl radical.

7. The process of claim 6 wherein $R^1$ is acetyl, propionyl, or caproyl.

8. The process of claim 6 wherein $R^1$ is an acyl radical of a carboxylic acid obtained from a naturally occurring fat or oil.

9. The process of claim 8 wherein $R^1$ is lauryl or oleyl.

10. The process of claim 1 wherein $R^1$ is a hydroxyalkyl radical of the formula

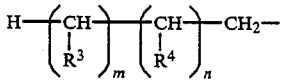

in which m and n are integers of 1 to 3 and at least two of the substituents $R^3$ and $R^4$ are hydroxy groups.

11. The process of claim 1 wherein $R^1$O— is an ether of ethanediol or glycerol.

* * * * *